US005399939A

United States Patent [19]

Greenberg et al.

[11] Patent Number: 5,399,939

[45] Date of Patent: Mar. 21, 1995

[54] MAGNETIC SHIELD WITH CATHODE RAY TUBE STANDOFF FOR A COMPUTER MONITOR

[75] Inventors: Sanford H. Greenberg; Richard France, both of Boulder; Frank Turner, Westminster, all of Colo.

[73] Assignee: Environmental Services & Products, Inc., Boulder, Colo.

[21] Appl. No.: 999,415

[22] Filed: Dec. 24, 1992

Related U.S. Application Data

[63] Continuation-in-part of Ser. No. 808,459, Jan. 3, 1992, abandoned.

[51] Int. Cl.[6] ..... H01J 1/52

[52] U.S. Cl. ..... 315/85; 315/8; 313/402; 313/479

[58] Field of Search ..... 315/8, 85; 313/402, 313/407, 479

[56] References Cited

U.S. PATENT DOCUMENTS

| | | | |
|---|---|---|---|
| 3,431,454 | 3/1969 | Sanders . | |
| 3,466,499 | 9/1969 | Beth . | |
| 3,879,633 | 4/1975 | Stark, Jr. . | |
| 4,000,432 | 12/1976 | Coon et al. | 313/242 |
| 4,084,215 | 4/1978 | Willenbrock | 315/85 X |
| 4,145,678 | 3/1979 | Takikawa | 335/214 |
| 4,152,745 | 5/1979 | Eul | 315/8 X |
| 4,220,890 | 9/1980 | Beekmans | 315/8 X |
| 4,392,083 | 7/1983 | Costello | 315/85 |
| 4,401,917 | 8/1983 | Gerritsen | 313/413 |
| 4,508,640 | 4/1985 | Kanda et al. | 252/503 |
| 4,517,494 | 5/1985 | Yasui et al. | 315/85 |
| 4,556,821 | 12/1985 | Cooper | 315/8 |
| 4,709,220 | 11/1987 | Sakane et al. | 335/214 |
| 4,749,625 | 6/1988 | Obayashi et al. | 428/624 |
| 4,767,969 | 8/1988 | Green | 315/85 |
| 4,792,317 | 12/1988 | Sipsma | 313/402 X |
| 4,806,894 | 2/1989 | Koto | 335/214 |
| 4,851,737 | 7/1989 | Johansson et al. | 315/8 |
| 4,853,588 | 8/1989 | Ohtsu et al. | 315/85 X |
| 4,853,790 | 8/1989 | Dickie | 313/479 X |
| 4,890,083 | 12/1989 | Trenkler et al. | 335/301 |
| 4,922,153 | 5/1990 | Kevius | 315/8 |
| 4,943,753 | 7/1990 | Heuesi | 313/440 |
| 4,943,755 | 7/1990 | Toshiyasu et al. | 315/8 |
| 4,947,083 | 8/1990 | Bosch et al. | 315/8 |
| 4,996,461 | 2/1991 | Bentley | 315/8 |
| 5,036,250 | 7/1991 | Sluyterman | 315/8 |
| 5,049,847 | 9/1991 | Okuyama | 315/8 X |

OTHER PUBLICATIONS

ELF Armor by Fairfield Engineering, 1991 (Brochure) pages labeled 1, 2, 3.

Alloy Data by Carpenter Technology Corporation, Brochure.

Cylindrical Shield Design by Carpenter Technology Corporation, Brochure.

Mag-NØt A Magnetic Radiation Absorber by TYV Inc., Brochure.

The No Rad Shield by the Body Mind Connection, Brochure.

Brodeur, Paul, The Magnetic-Field Menace, Macworld.

Instruction Manual for ELF Sense TM by Exper Test TM, Inc.

Introducing the Complete Family of Glare/Guard ® Anti-Glare Filters by Glare/Guard ® Brochure.

*Primary Examiner*—Robert J. Pascal

*Assistant Examiner*—Haissa Philogene

*Attorney, Agent, or Firm*—Shlesinger Arkwright & Garvey

[57] ABSTRACT

A shield for a computer monitor comprises a hollow cylindrical magnetic sleeve disposed around at least a portion of the yoke windings of the monitor. The sleeve has a diameter greater than the diameter of the yoke windings. A cathode ray tube (CRT) standoff for the shield provides for ease of shield installation and continued operation of the monitor within specification without impairing image integrity (i.e. distortion, color impurity or brightness). The standoff creates a specific distance (critical threshold) between the glass bell of the CRT and the shield that prevents image distortion that cannot be overcome through adjusments of the monitor controls (critical interference).

14 Claims, 8 Drawing Sheets

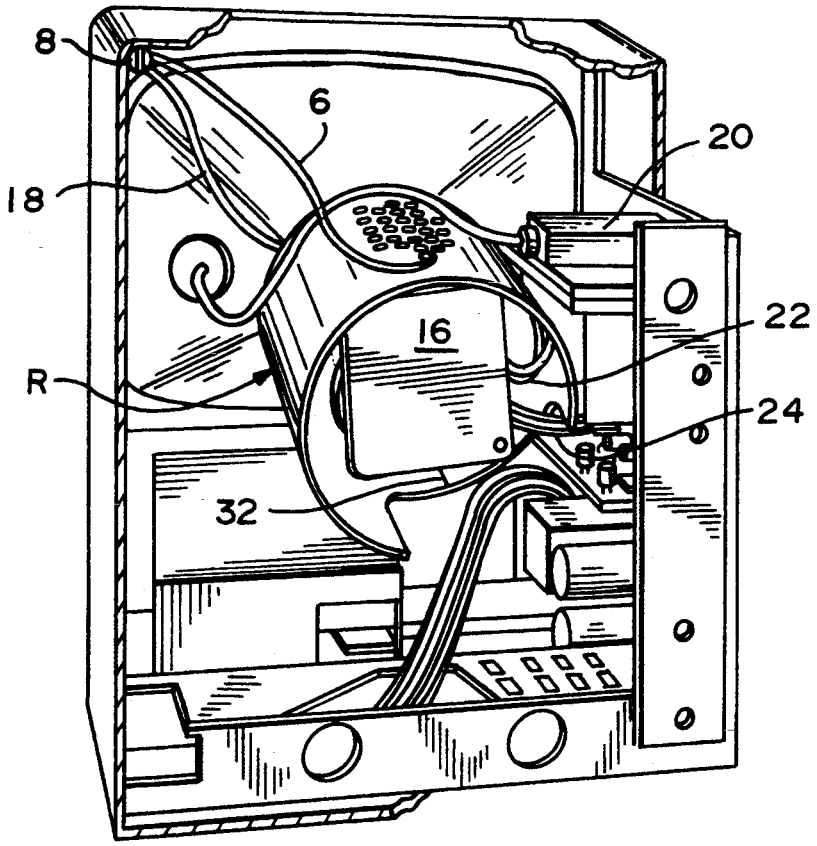
FIG. 2
FIG. 1
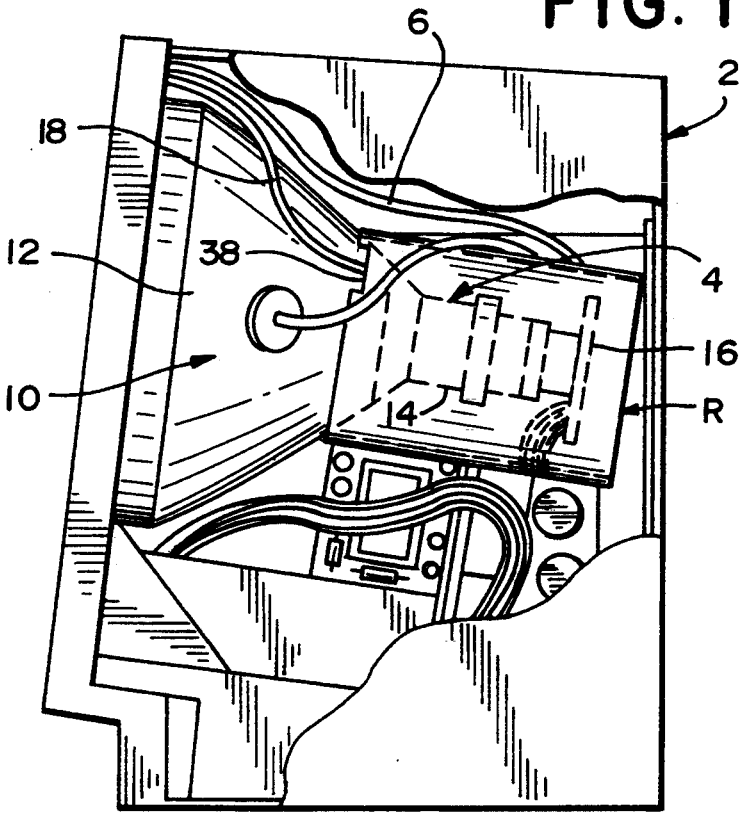

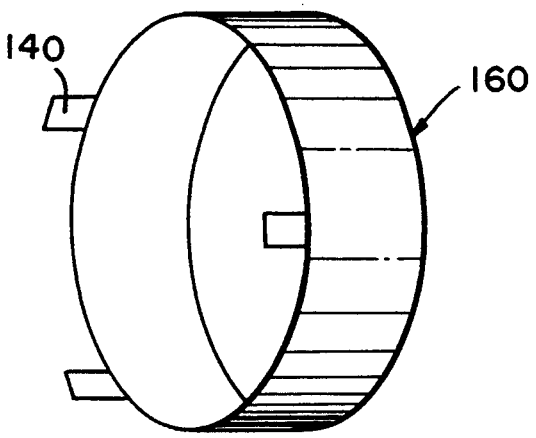
FIG. 10(b)
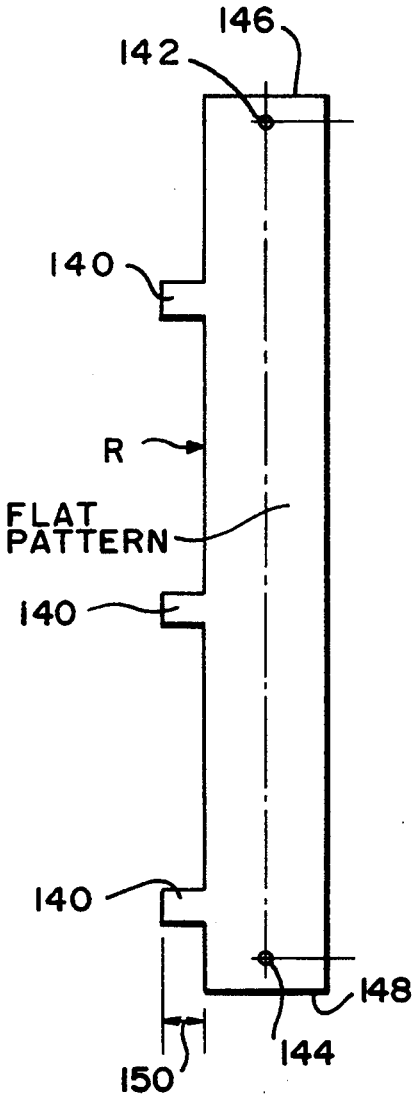
FIG. 10(a)
FIG. 10(c)
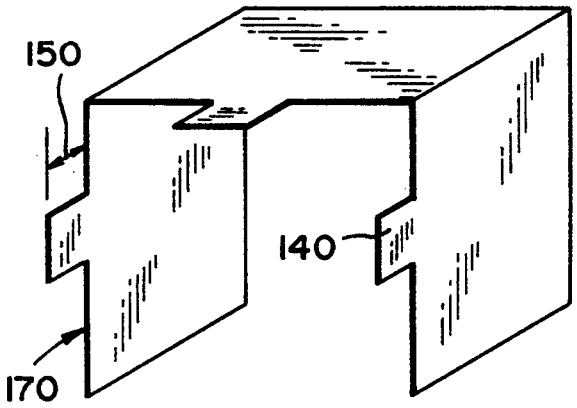

FIG. 11a
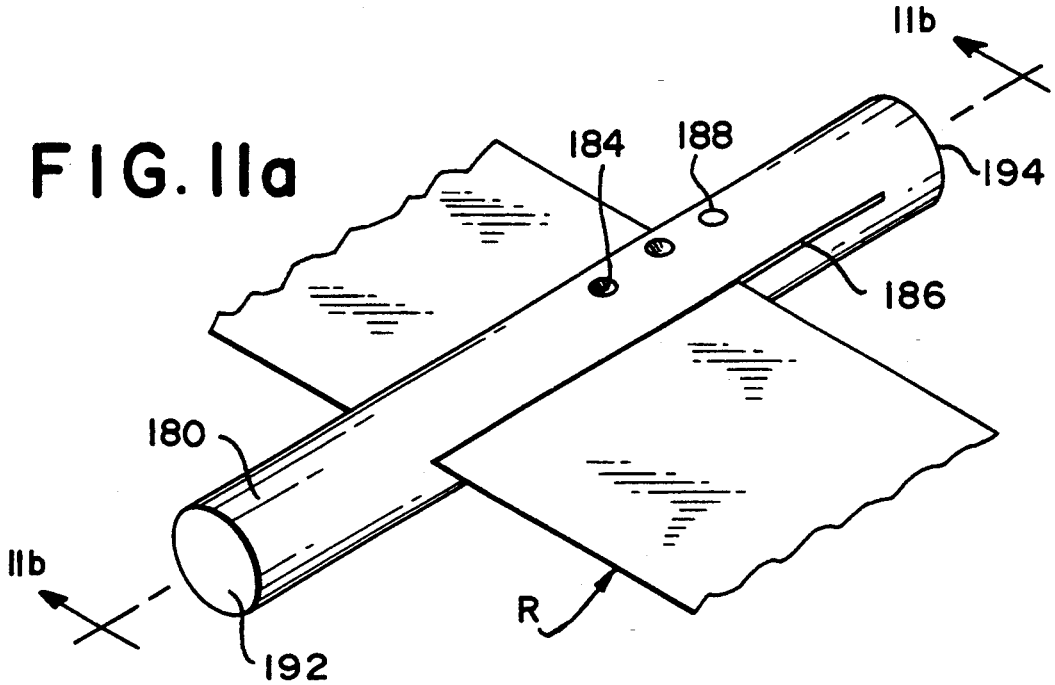
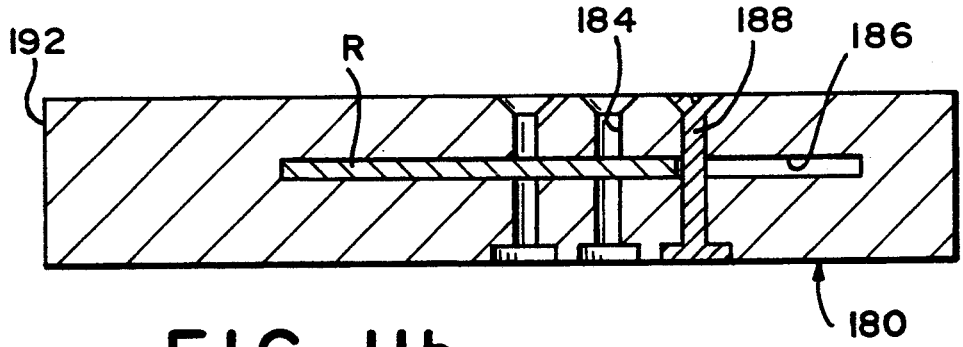
FIG. 11b
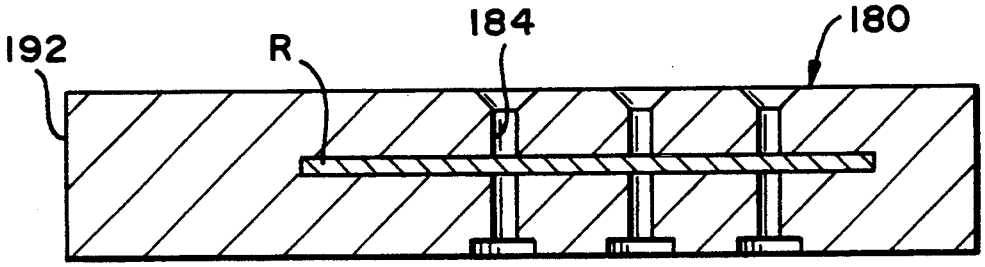
FIG. 11c

MAGNETIC SHIELD WITH CATHODE RAY TUBE STANDOFF FOR A COMPUTER MONITOR

This is a continuation-in-part of application Ser. No. 07/808,459, filed Jan. 3, 1992, which has been abandoned.

FIELD OF THE INVENTION

The present invention relates to a magnetic shield with a cathode ray tube (CRT) standoff for computer monitors that effectively shields ELF (extremely-low frequency) and VLF (very-low frequency) electromagnetic radiation generated by the monitors.

BACKGROUND OF THE INVENTION

Extremely-Low Frequency Electro-Magnetic Radiation (hereinafter referred to as ELF radiation) has been suspected as a possible health hazard involving a wide variety of ills, including immune system injury, cataracts, blurred vision, memory loss, stress, leukemia, interference with the body's natural electro-magnetic fields, abnormal pregnancies, and miscarriages. The ELF radiation that health officials and scientists are most concerned about is in the range of 2 Hz–5 kHz.

ELF radiation is present whenever there are hi-voltage power lines and electric appliances. In computer monitors, magnetic fields guide the electron beams that draw the image on the screen. In the process,-radiation is created that emanates from the neck of the monitor. Travelling in arcs to all sides and to the front of the monitor, this radiation passes completely through the monitor's case and the operator's body.

Common electric appliances such as television sets and hair dryers emit ELF radiation fields. However, exposure to them is usually brief and/or from a distance, entailing low risk. On the other hand, computer monitors often emit ELF radiation as far away as three feet. Computer operators usually sit less than three feet from their computers, entailing substantially greater risk.

Most of the radiation to which one is exposed originates from the neck of the tube and travels in arcs—several feet around and in front of the screen. The deeper the monitor, the stronger the radiation emissions. Relatively very little ELF radiation comes directly from the screen area of a monitor. Thus, all screen-mount filters only afford relatively minimal protection.

Currently available computer monitor ELF radiation shields include external iron-strap shields, internal iron-cylinder shields, coated wire screen filters and coated glass screen filters. Testing of these shields in the 2 Hz to 5 kHz range indicated reductions in the ELF radiation from about 5% to 73%.

Because of the possible health hazards associated with computer monitors, there is the need for improved computer monitor shields that comparatively reduce ELF radiation emissions in view of what is now available.

OBJECTS AND SUMMARY OF THE INVENTION

We have found that the design of a shield and its installation within the monitor requires consideration of the following parameters for effective shielding. These parameters include: the composition of the metal used in the shield; the thickness (gauge) of the metal used; the shield's dimensions as to length, diameter and adjustability; the proximity of the shield to the glass bell of the CRT; the monitor's component level flux balance; the monitor's sensitivity to and introduction of external magnetic fields; the monitor's inherent design in which limitations are imposed as to installation of the shield; and the effects of the shield on image brightness, convergence, color purity, focus, and shape. Each of these factors pose tradeoffs in a shield design with respect to the fundamental purposes of the shield and the monitor, e.g. radiation shielding effectiveness and image integrity.

We have also found that interference with the magnetic flux balance of a monitor without a properly designed or installed shield can cause distortion, color impurity or alter brightness thereon. Such problems can be major where the shield inherently prevents proper functioning or requires the installer to correct these imbalances by recalibration of the monitor. These recalibrations can be simple (i.e. requiring calibrations 5 minutes long) or complex (i.e. 30 minutes long) depending upon the magnetic flux geometry and the monitor's adjustment controls (if available on the particular monitor).

We have found that for proper shield design to afford maximum shielding effectiveness without affecting monitor performance, certain features must be incorporated with the shield. For example, many color monitors have fixed components which require a small diameter shield. This in turn can cause image distortion once installed. Furthermore, if during the shield installation the monitor's manual adjustments will not bring the monitor back to specification (a condition we refer to as "critical interference"), one or more counter-balancing techniques must be used. These techniques include: 1) physically placing the shield more distant from the face of the CRT; 2) shortening the length of the shield; 3) making the shield metal thinner; 4) adjusting the shield's diameter; and/or 5) changing the shield material. It is very important to note that many monitors exhibit very small tolerance to shield adjustments, necessitating exacting shield specifications and tiny adjustment increments. Presently available ELF shields do not have physical means to bring about these requirements to facilitate installation thereof. Thus, the present invention effectuates these requirements and allows for correct and reliable shield installation.

It is an object of the present invention to provide a monitor shield that will provide relatively increased radiation reduction.

It is another object of the present invention to provide a monitor shield that utilizes a corrosion resistant specialty metal that is impervious to rust, thereby avoiding the formation of rust, which could be a performance/safety factor in the operation of the monitor.

It is still another object of the present invention to provide a monitor shield that provides heat ventilation and/or dissipation to prevent heat build up within the monitor and its chassis.

It is yet another object of the present invention to provide a monitor shield that attains closer contact to the glass bell of the CRT, thus providing more coverage over the yoke windings for increased reduction in ELF radiation.

It is a further object of the invention to attain maximum shielding effectiveness while maintaining both the original (unshielded) image integrity (or better) and the expected life cycle of the monitor (or better).

It is an object of the present invention to provide a monitor shield that minimizes distortion of the monitor image.

It is still another object of the present invention to provide a monitor shield that has an adjustable diameter to thereby fit models to a larger range of monitors.

It is another object of the present invention to provide a monitor shield that provides ease in installation and incorporates a standoff means to eliminate critical interference.

It is still another object of the present invention to provide a monitor shield with a standoff which allows for adjustable positioning of the shield relative to the CRT glass bell.

In summary, the present invention provides a monitor shield that achieves relatively greater ELF radiation reduction with features that allow for simple and effective installation in view of what is now available.

These and other objects of the present invention will become apparent from the following detailed description.

BRIEF DESCRIPTIONS OF THE DRAWINGS

FIG. 1 is a side elevational view of a computer monitor, with portions broken away, showing a shield made in accordance with the present invention installed therein.

FIG. 2 is a rear perspective view of the monitor of FIG. 1, with portions broken away, showing the installed shield.

Figure 8A:
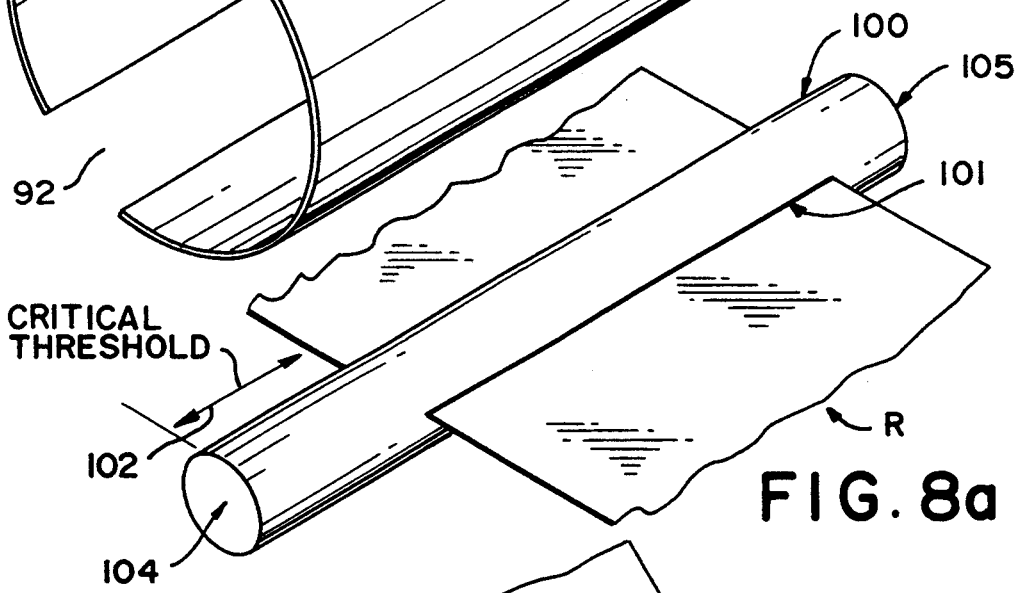

FIG. 8*a* is a perspective view of yet another embodiment of the invention showing a rod standoff incorporated with the shield.

Figure 8B:
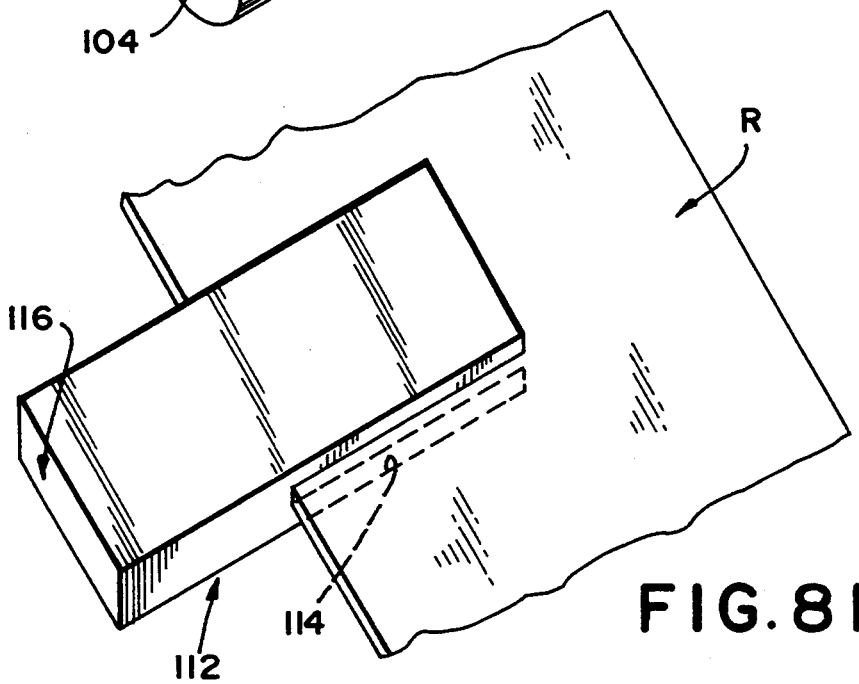

FIG. 8*b* is a perspective view of a still further embodiment of the invention.

Figures 9A, 9B, 9C, 9D:
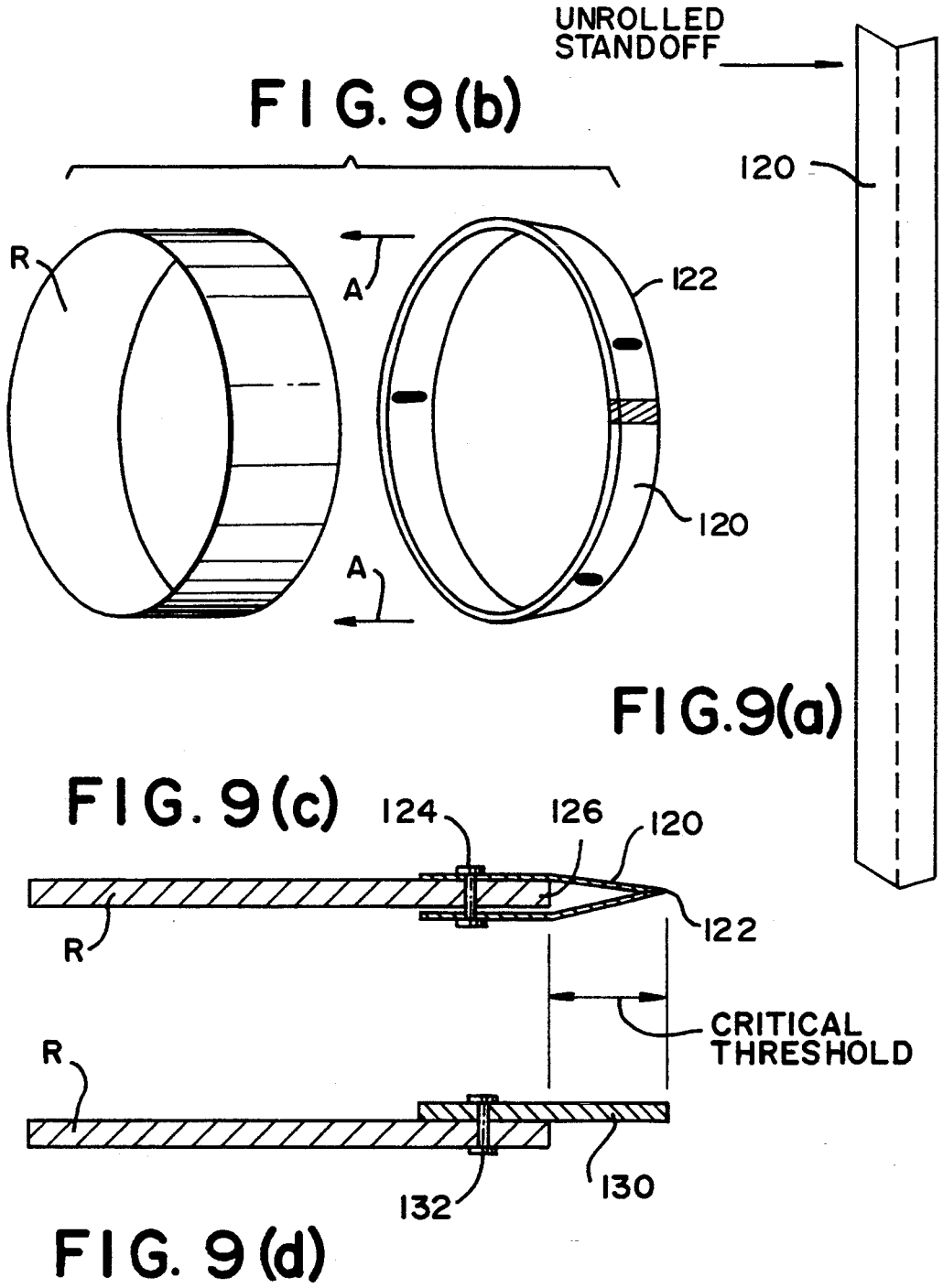

FIG. 9*a* shows another embodiment of a standoff according to the invention in an unrolled state.

FIG. 9*b* shows a perspective view of a further embodiment of the invention as it is being assembled.

FIG. 9*c* is a sectional view of the embodiment of FIG. 9*b*.

FIG. 9*d* is a view similar to FIG. 9*c* of a still further preferred embodiment of the invention.

FIG. 10*a* is a plan view of a flat pattern for an integral shield and standoff according to the invention.

FIG. 10*b* is a perspective view of the preferred embodiment of a cylindrical shield having standoffs formed from the flat pattern of FIG. 10*a*.

FIG. 10*c* is a plan view of a rectilinear embodiment of a shield formed from the flat pattern of FIG. 10*a*.

FIG. 11*a* is a perspective view of another embodiment of the invention.

FIG. 11*b* is a sectional view taken along line 11*b*—11*b* of FIG. 11*a*.

FIG. 11*c* is a sectional view of FIG. 11*b*.

Figure 12A:
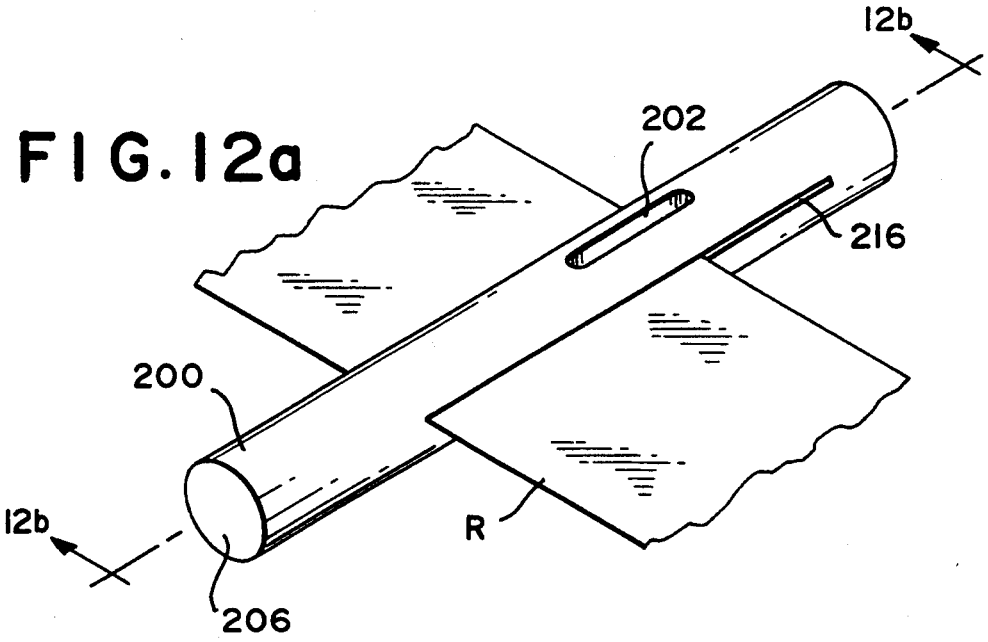

FIG. 12*a* is a perspective view of a still further preferred embodiment of the invention.

Figure 12B:
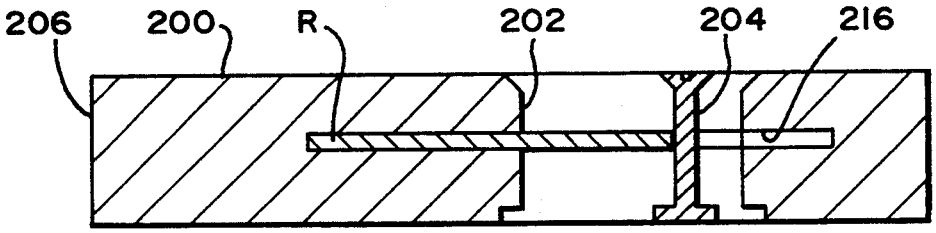

FIG. 12*b* is a sectional view of FIG. 12*a* taken along line 12*b*—12*b*.

Figure 12C:
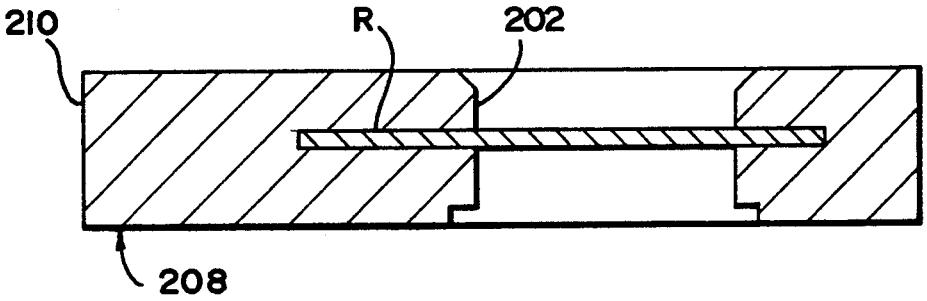

FIG. 12*c* is a sectional view similar to FIG. 12*b*.

DETAILED DESCRIPTION OF THE INVENTION

An embodiment of a shield R installed in a computer monitor 2 is disclosed in FIG. 1. The shield R is hollow metallic cylinder disposed around yoke windings 4 of the monitor. A ground wire 6 connects the shield R to the chassis of the monitor 2 with screws 8 or other standard fastener. The source of ELF radiation in the monitor is the yoke windings 4. The shield R therefore advantageously encloses the yoke windings 4, as best shown in FIGS. 1 and 2.

The monitor 2 is integrated with an Apple Macintosh Classic (registered trademark) computer and includes an evacuated glass tube or cathode ray tube (CRT) 10 having a glass bell 12 and a neck portion 14. An electron gun (not shown) is disposed in the neck portion 14 and produces a narrow electron beam within the tube 10. A video board 16 is disposed at the neck portion 14. A ground wire 18 connects the video board 16 to the chassis of the monitor 2. The yoke windings 4 disposed around the neck portion 14 of the CRT 10 controls the movement of the electron beam across the screen of the monitor 2. A flyback transformer converts the voltage from 110 VAC typically to between 40,000 and 100,000 VAC. This voltage is transferred to the yoke coil windings which in turn accelerate and direct the electron beam toward the screen of the monitor. Wires 22 connect the yoke windings 4 to computer video circuitry 20. Wires 24 connect the small video board 16 to other circuit components.

Although the shield R is described above in relation to a specific monitor model, a person of ordinary skill in the art will understand that the shield R is equally applicable to other monitors that require radiation suppression.

The electric and magnetic fields generated in the monitor 2 are in the ELF and VLF ranges. Current flowing through the yoke windings 4 produces magnetic fields that control the electron beam. The yoke windings 4 incorporates a horizontal deflection coil that forces the beam from left to right and a vertical deflection coil that moves the beam vertically. The horizontal-scan frequency for a typical computer monitor is generally between 10 kHz and 30 kHz, which falls in the very-low-frequency (VLF) range. The vertical-scanning frequency is between 60 Hz and 75 Hz, which is within the extremely-low-frequency (ELF) range (2 Hz to 5 kHz).

Figure 3:
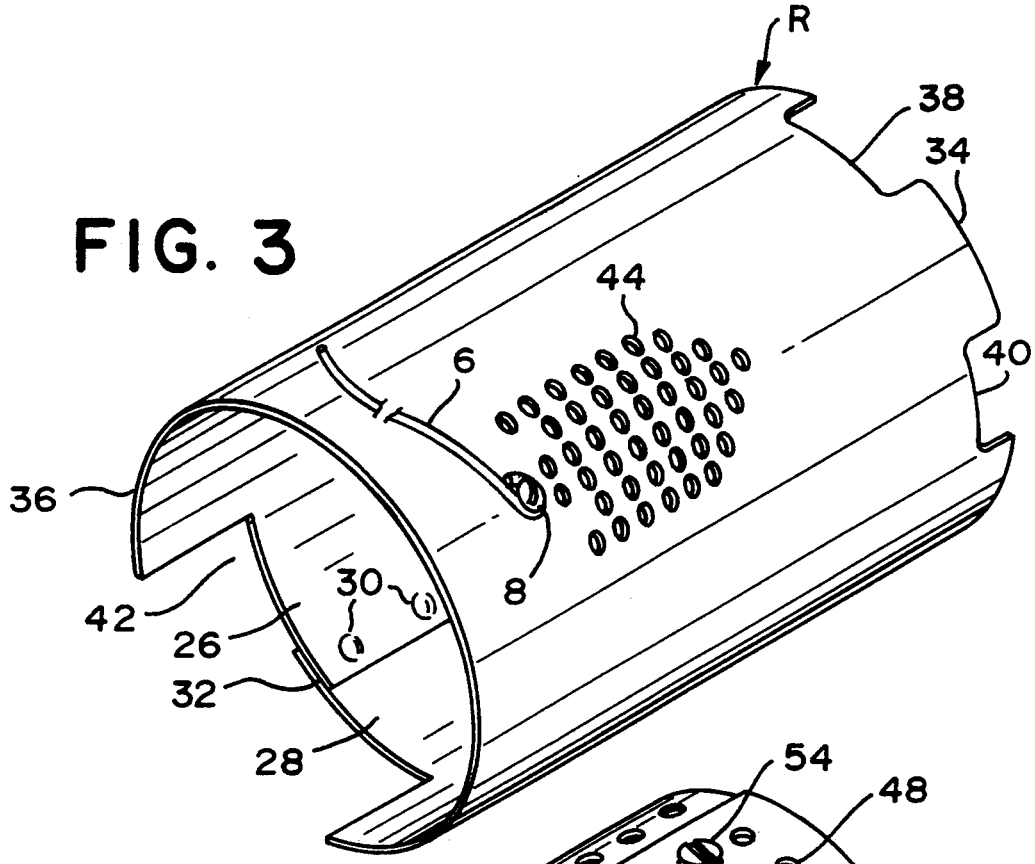
FIG. 3 is a perspective view of the shield shown in FIGS. 1 and 2 with the intrinsic shield standoff feature incorporated with the shield.

The shield R is disclosed in greater detail in FIG. 3. The shield R is fabricated from a special sheet metal and formed into a hollow cylinder by securing together its opposite end portions 26 and 28 by welding tacks 30 or other standard fastening means. A seam 32 is thereby formed. The shield R has a front end portion 34 that is disposed near the front of the monitor's glass bell 12 and a rear portion 36 that is disposed towards the rear of the monitor 2, as best shown in FIGS. 1 and 3.

The front end portion 34 includes perimeter cutouts or slots 38 and 40, preferably rectangular in shape with rounded corners that are stamped or cut with predetermined critical threshold lengths during the manufacture thereof that avoid "critical interference" for a given monitor. The cutouts 38 and 40 are adapted to accommodate various electrical wires or other components within the monitor 2 and include the required shield standoff from the CRT to thereby fit the front end portion 34 closer to the bell portion 12 of the cathode ray tube 10 and avoid critical interference. For example, the cutout 38 can be approximately ¼" deep and 1⅛" long and the cutout 40 can be about ½" deep and 1½" long.

The rear portion 36 has a perimeter cutout or slot 42, preferably rectangular in shape. The cutout 42 is adapted for accommodating various electric components, such as wires, etc., located at the rear of the monitor 2. The cutout 42 is about 1⅝" deep and 3⅛" long.

A plurality of holes 44 may be disposed on an upper portion of the shield R when secured within the monitor 2. The holes 44 provide means for advantageously ventilating any heat build up within the shield R and for regulating the suppression of the monitor's magnetic flux emissions. The holes 44 are arrayed in the shape of an arrow head pointing to the front portion 34 of the shield 2.

The cutout 38 advantageously permits the ground wire 18 to pass through the shield R without affecting the close fit between the front end portion 34 of the shield R and the bell portion 12 of the tube 10. Similarly, the cutout 40 advantageously permits the yoke wires 22 to pass through the shield R. The cutout 42 further provides adequate clearance for the video board wires. Thus, the shield R attains a close fit with the bell portion 12 of the monitor 2, thereby providing relatively greater shielding effectiveness.

The seam 32 is typically a weak spot in terms of shielding capability. Thus, the seam 32 is preferably disposed below the yoke windings 4, as best shown in FIG. 2.

The shield R has an inside diameter approximately 4" and length approximately 5⅜". The shield R as dimensioned is suitable for Apple compact computers such as Macintosh 128K, 512K, 512E, Plus, SE, SE/30, Classic and Classic II, etc.

The material for the shield R is preferably made from a soft magnetic alloy comprising about 80% nickel, 4.20% molybdenum and 15% iron that develops extremely high permeabilities with minimum hysteresis loss. This material is available from Carpenter Technology Corp., Carpenter Steel Division under the brand name HIPERNOM (Registered Trademark) alloy. The gauge of the material is preferably from 0.015 to 0.030 inch. The specific material and thickness have been shown to provide relatively effective radiation reduction.

Figure 4:
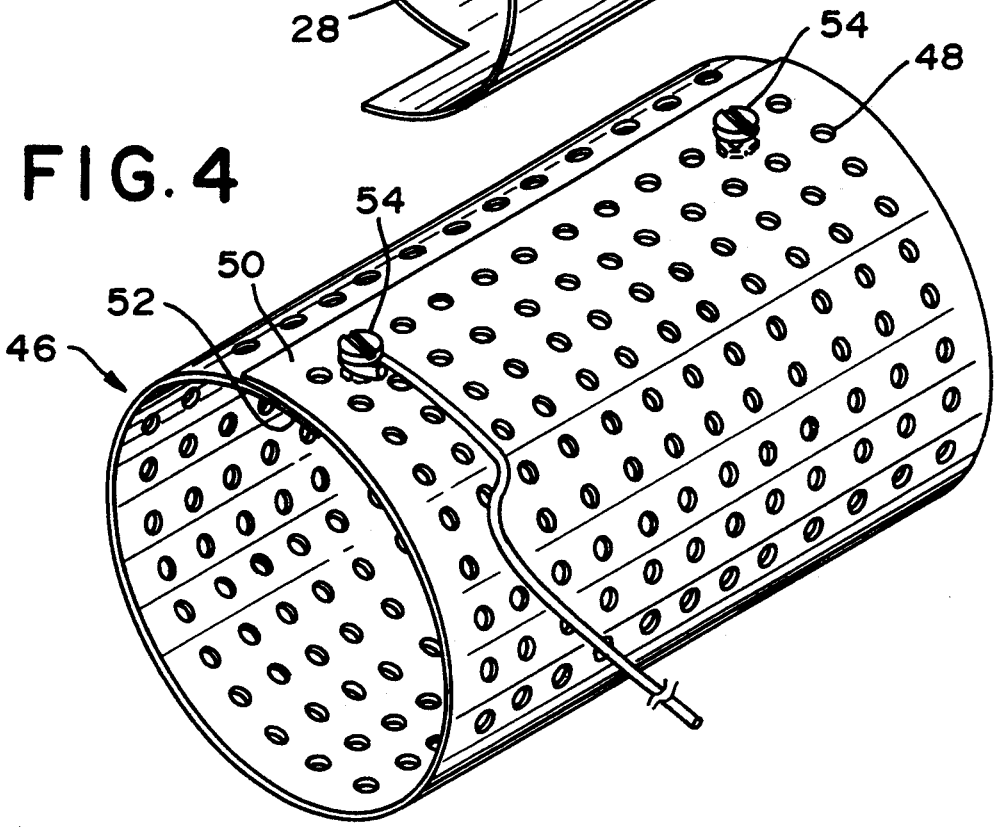
FIG. 4 is a perspective view of another embodiment of a shield made in accordance with the present invention.

Another embodiment of the shield R is disclosed in FIG. 4 as shield 46. The same material with the same thickness range as used for the shield R is used for the shield 46. The shield 46 includes a plurality of holes 48 disposed throughout its surface. Overlapped edge portions 50 and 52 are secured to each other by removable screws 54, thereby advantageously permitting the shield 46 to attain a variable diameter to fit it around variously sized yoke windings 4. A ground wire 56 is provided to electrically connect the shield 46 to the chassis of the monitor 2. The plurality of holes 48 preferably has a hole density ranging from 9 to 20 holes per square inch.

The holes 48 provide relatively greater adjustability for linearity of the monitor. The holes 48 reduce shielding by about 2% while improving screen adjustability for linearity by 6.25%. Each of the holes 48 has a diameter of approximately 2–4 cm.

Velcro (registered trademark) type fastener (not shown) may be provided on the outside surface of the shield 46 to secure it to supporting surfaces within the monitor.

The diameter of the shield 46 may be as little as ½" greater than the diameter of the yoke windings to as large as will fit within the monitor enclosure. The length/depth of the shield 46 may extend from the glass bell of the CRT to the rear of the monitor without hitting an obstruction.

Figure 5:
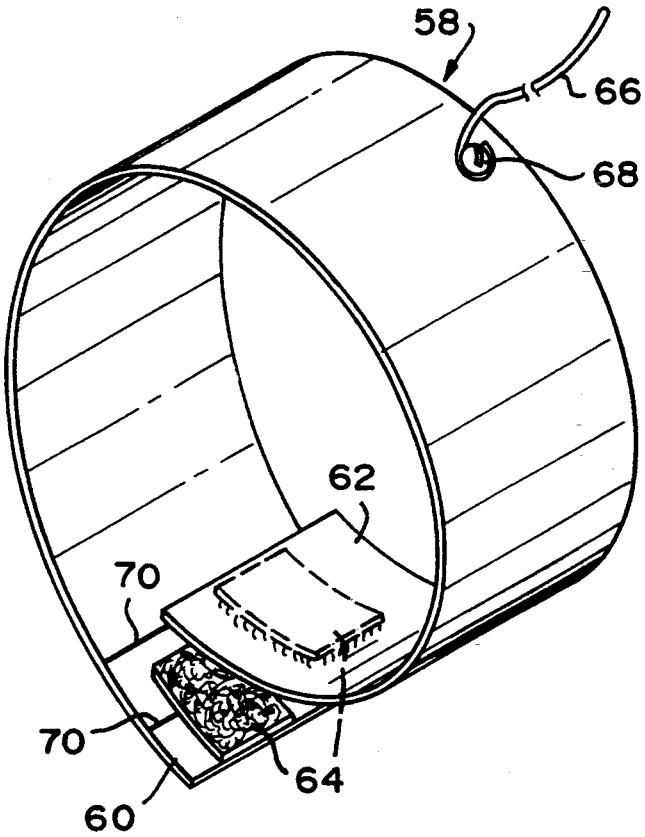
FIG. 5 is a perspective view of yet another embodiment of a shield made in accordance with the present invention.

Another embodiment of the shield R is disclosed in FIG. 5 as shield 58. The shield 58 is formed into a hollow cylinder from the same material with the same range of thickness as used for the shield R. The shield 58 is formed by overlapping end portions 60 and 62 to each other by means of VELCRO (Registered Trademark)-type fastener 64 or other standard fasteners. The shield 58 has an adjustable diameter provided by the VELCRO fastener 64, thereby advantageously permitting the shield 58 to fit in a wide range of monitors 2. The end portions 60 and 62 are preferably 1" overlapped. Additional fasteners (not shown) may be provided on the outside surface of the shield 58 to secure it to support surfaces within the monitor.

A spacer block (not shown), preferably made of heat resistant, non-outgassing nylon or other suitable material, may be disposed within the shield 58 above the yoke windings 4 to provide proper spacing of the shield 58 above the yoke windings 4. A ground wire 66 secured by screw 68 is provided to electrically connect the shield 58 to the chassis of the monitor 2, thereby providing a path to ground for any induced currents in the shield 58. Indicia lines 70 to indicate minimum and maximum tolerances are provided on a surface of the shield 58 to advantageously assist the installer in fine-tuning the shield 36 during installation.

The shield 58 can be as narrow as 1" wide and 26" long and turned into overlapping circles. The shield 58 has a diameter equal to the diameter of the yoke winding plus a minimum of at least ½" to a maximum diameter that can be uniformly expanded around the yoke windings without touching the video control board components surrounding it.

Figure 6:
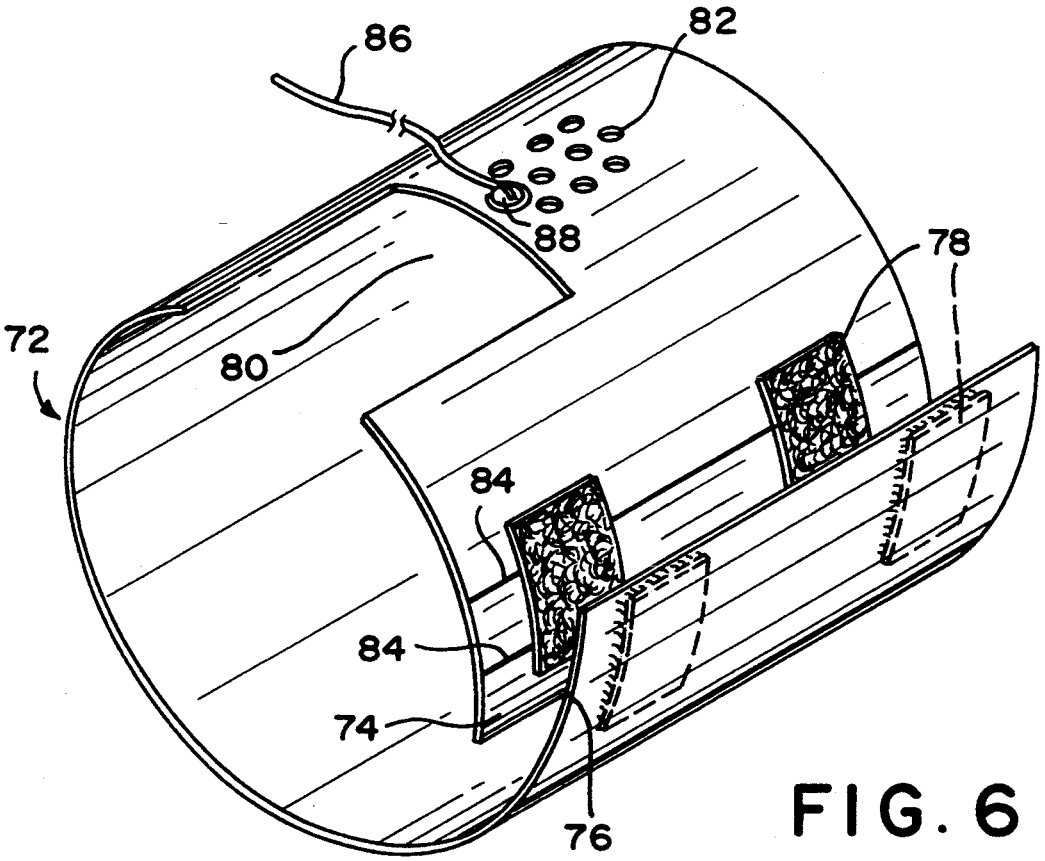
FIG. 6 is a perspective view of yet another embodiment of a shield made in accordance with the present invention.

Still another embodiment of the shield R is disclosed in FIG. 6 as shield 72. The shield 72 uses the same material with the same thickness range as the shield R. The shield 72 has overlapping end portions 74 and 76 that are secured to each other by means of VELCRO (Registered Trademark) fasteners 78 or other standard fastening means. Additional fasteners (not shown) may be provided on the outside surface of the shield 72 to secure the shield to supporting surfaces in the monitor. The end portions 74 and 76 are preferably overlapped, from ½" up to 2".

A cutout or slot 80 is disposed at an end portion of the shield 72 to accommodate electrical components, such as wires, flyback transformer, etc. within the monitor. The cutout 80 is approximately 3" deep and 3" long.

A plurality of holes 82 provide ventilation means to prevent heat build up and to regulate the suppression of the monitor's magnetic flux emissions. Indicia lines 84 to indicate minimum and maximum tolerances are provided on the surface of the shield 72 to advantageously assist the installer in fine-tuning the shield 72 during installation.

A ground wire 86 secured with screw 88 is provided to electrically connect the shield 72 to the chassis of the monitor. The ground wire 86 will safely conduct any induced currents in the shield 72 to ground.

The shield 72 is approximately 22" long, $5\frac{3}{4}$" deep and formed between $5\frac{3}{4}$" to $6\frac{1}{4}$" diameter overlapping circle.

Figure 7:
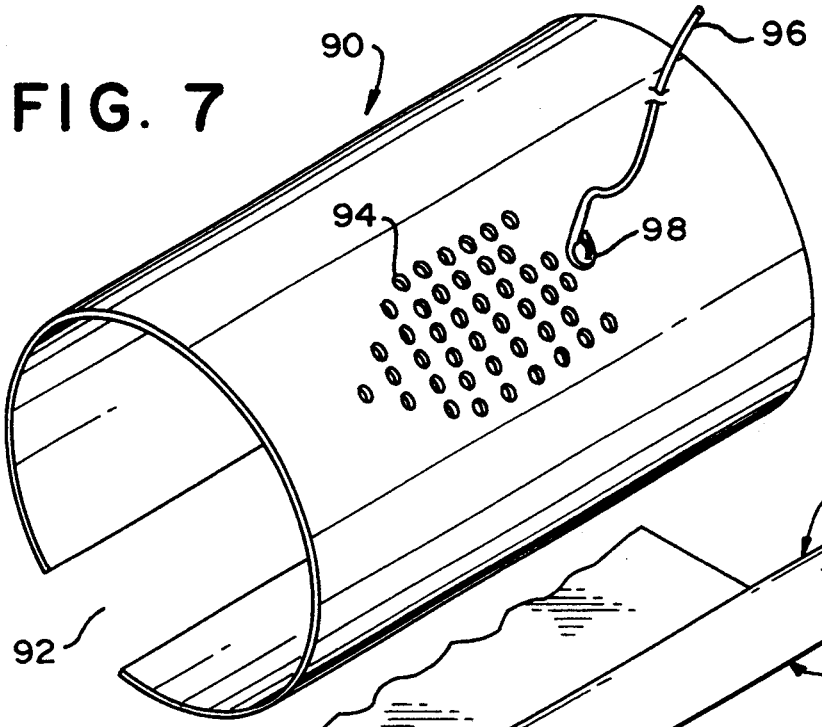
FIG. 7 is a perspective view of still another embodiment of a shield made in accordance with the present invention.

Another embodiment of shield R is disclosed as shield 90 in FIG. 7. The shield 90 is substantially cylindrical with a longitudinal gap or slot 92 ranging from 1" to 3" throughout its entire length. The shield 90 is formed from the same material with the same thickness range as the shield R. The slot 92 is adapted to accommodate obstructions within the monitor that otherwise will not permit a full cylindrical shield to be installed. Holes 94 provide heat ventilation and further regulation of magnetic flux emissions. A ground wire 96 secured with screw 98 is provided to safely conduct any induced currents in the shield 90 to ground.

The shield 58 is narrower than the shield 72 to enable the shield 58 to clear some electrical components within the monitor, such as a flyback transformer, etc.

The shields 58 and 72 produce relatively zero distortion of the monitor image after routine adjustments following installation.

The adjustability feature of the shields 46, 58 and 72 permit optimally balancing the small but significant field differences between each unique monitor, resulting in optimal image quality and maximum ELF/VLF radiation shielding, thereby permitting retrofit of a multitude of monitors.

The shield R was tested in a Macintosh Classic computer with integral 9" monitor, using an ELF magnetic field meter made by ExpanTest TM, Inc Portland, Me. 04102. The test indicated that the shield R reduced the ELF radiation 10" in the front of the monitor 2 by 81.3% and 10" at the side by 61.8%.

The shield 46 was tested in an Apple 13" High Resolution RGB monitor, using the same ELF magnetic meter as used for the shield R. The shield 46 was found to reduce the ELF radiation at 10" in front of the monitor by 69%.

The shields 58 and 72 were also tested in an Apple 13" High Resolution RGB monitor, using the same ELF magnetic field meter. The test indicated that shield 58 provided a 65.2% reduction of the ELF radiation at 10" in front of the monitor and 67.8% reduction at 10" away from the sides. Similarly, the shield 72 provided 84.88% reduction at 12" in front of the monitor and 80% reduction at 12" from the sides.

Another feature of the invention is a shield which incorporates a standoff feature so as to cure critical interference as defined above.

The standoff feature creates a continuous space between the shield and the glass bell of the CRT which it encloses. We have found that providing for this continuous space is often effective in curing critical interference. We have also found that this space increases shielding effectiveness in some cases.

This standoff feature creates a specific distance we call the critical threshold to cure the critical interference problem and eases or eliminates the need to recalibrate the monitor after installation. Each monitor type has a specific critical threshold. When a shield is installed within its critical threshold, critical interference is eliminated. As discussed above, critical interference is a condition caused by the shield's interference with the proper functioning of the monitor that cannot be overcome through adjustment of the monitor's controls. Critical threshold for a monitor type is determined through testing. The standoff feature allows for the adjustment of the critical threshold until critical interference is eliminated, thereby reducing the required installation time and assures reliable ELF radiation shielding for a given monitor.

We have found that shields fitted with the proper type of shield standoff can reduce or eliminate the need to recalibrate the monitor following shield installation, thus advantageously simplifying overall installation and reducing installation time. Furthermore, the shield standoffs often advantageously allow shields to be more easily and securely installed within the monitor enclosure.

We have found that if the distance between the shield and the glass bell is too wide, a loss of shielding effectiveness would result. Conversely, if the distance is too narrow, the shield would interfere with the electromagnetic control field and degrade the image produced by the CRT.

The shield standoffs are preferably fabricated from non-magnetic, heat resistant and non-outgassing type materials.

FIG. 8*a* shows a rod-like standoff 100 which is cylindrical but can be in a variety of shapes. The length of standoff 100 can be from one to six inches. Standoff 100 requires a slot 101 to be a predetermined cut lengthwise for insertion of shield R. For maximum stability, standoff 100 in FIG. 8*a* would be the desired form. The width of slot 101 varies with the gauge of the shielding material used so as to allow ease in sliding shield R through slot 101 and still be held snugly within. The shield R can be affixed to standoff 100 in an appropriate manner such as by bolting, gluing or a friction-fit.

Installed, a foot 104 of standoff 100 rests against the CRT's glass bell where the shield is within a predetermined critical threshold 102. A second foot 105 extends rearwardly away from the CRT when foot 104 is the part of standoff 100 establishing the desired critical threshold.

Further, standoff 100 allows for shield installation two ways. First, it can be installed as shown with designated foot 104 resting against the CRT or second, by rotating the shield/standoff structure 180 degrees, thereby using the other foot 105 of standoff rod 100 to abut the CRT. Thus, two standoff dimensions with different critical thresholds may be achieved with the same rod.

FIG. 8*b* shows a standoff 112 having a recess 114 for receiving Shield R inserted therein. Shield R may be fastened by glue or rivets to prevent lateral movement. A foot 116 abuts the CRT when standoff 112 is in use.

Another embodiment of the invention is shown in FIGS. 9*a*, 9*b* and 9*c*. A standoff 120 is shown in its unrolled state in FIG. 9*a*. The standoff 120 is fabricated from flexible non-magnetic pliable flat sheet stock material, e.g. plastic or aluminum sheets, which is $\frac{1}{2}$" to 5" wide by up to 30" long in accordance with the critical threshold dimensions. Depending on the tensile strength and thickness of the material, the flat sheet stock of standoff 120 shown in FIG. 9*a* may or may not be folded lengthwise.

FIG. 9*b* shows standoff 120 being installed in the direction of arrows A on shield R after standoff 120 has been worked to have a configuration suitable for mating with shield R. This standoff has a foot 122 and is anchored to shield R with fasteners 124 along a front edge 126 of the active shield as shown in FIG. 9*c*.

FIG. 9*d* shows another embodiment in which a standoff 130 is attached by a fastener 132 to shield R.

Further, the continuous design of the embodiments of FIGS. 9*a–c* provides for maximum mounting stability for certain applications.

Yet another embodiment of the standoff feature is shown in FIG. 10*a* that includes the integral design in which the standoff tabs 140 are stamped or cut out during shield R fabrication in flat pattern form. The tabs 140 lengths correspond to a required critical threshold length 150. This standoff technique may be the most cost effective way to manufacture. Apertures 142 and 144 may be provided to serve as holes through which a fastener joins opposed ends 146 and 148 together. Other suitable joining of ends 146 and 148 is possible, such as welding or gluing.

FIG. 10*b* shows the flat pattern of FIG. 10*a* formed into an cylindrical shield 160.

FIG. 10*c* illustrates a rectilinear shield 170 formed from the flat pattern of FIG. 10*a*.

Yet still another embodiment of the invention is shown in FIGS. 11*a*, 11*b*, and 11*c* that shows a universal standoff 180 for retrofitted shields R. This standoff 180 allows for adjustable fastening of shortened shield R for curing critical interference when required. Fastener holes 184 that extend substantially 90 degrees from a shield slot 186 are used for affixing shield 182 by fasteners 188 to standoff 180. Standoff 180 has opposed feet 192 and 194 which abut the CRT in turn, as in the embodiment of FIG. 8*a*, and provide additional adjustability of the critical threshold, as required.

The embodiment of FIGS. 12*a–*12*c* illustrates a standoff 200 having an adjustment slot 202. A fastener 204 provides infinite adjustment of the critical threshold distance between a foot 206 and shield R.

FIG. 12*b* shows how a fastener 204 secures shield R in a desired position in a shield slot 216.

FIG. 12*c* illustrates the manner in which shield R is friction fit with shield slot 216. The critical threshold is achieved in this case by cutting off or filing off part of a free end 208 of standoff 206 thereby varying the distance between foot 210 and shield R.

While this invention has been described as having preferred designs, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A shield for a computer monitor of the type including an evacuated tube having a screen portion, a bell portion and a neck portion; means for generating a beam of charged particles toward the screen portion; and means disposed at the neck portion for deflecting a beam of charged particles; the deflecting means having a diameter; said shield comprising:

a) a hollow cylindrical magnetic sleeve configured for being disposed around at least a portion of the deflecting means;

b) a leg attached to said sleeve for establishing a standoff distance between said magnetic sleeve and a bell portion of an evacuated tube, said standoff distance establishing a critical threshold between the bell portion and said magnetic sleeve for curing critical interference;

c) said leg extending outwardly of said shield and including a foot configured for contacting the bell portion of the evacuated tube;

d) said foot being disposed at a predetermined distance from said sleeve and establishes said critical threshold; and e) said sleeve has a diameter greater than the diameter of the deflecting means.

2. A shield as in claim 1, wherein:

a) said sleeve includes means for adjusting its diameter.

3. A shield as in claim 2, wherein:

a) said sleeve is formed from a sheet having first and second opposite end portions;

b) means is provided for removably securing said first and second opposite end portions to each other.

4. A shield as in claim 1, wherein:

a) means is disposed on said leg for adjusting said predetermined distance between said foot and said sleeve.

5. A shield as in claim 1, wherein:

a) said sleeve includes a plurality of holes.

6. A shield as in claim 1 wherein:

a) said leg includes a rod-like structure having a slot receiving a portion of said sleeve.

7. A shield as in claim 6 wherein:

a) said rod-like structure has an opening defined in a central portion thereof, said opening being configured for receiving said sleeve therethrough.

8. A shield as in claim 1, wherein:

a) said sleeve comprises a first material;

b) said leg comprises a second material different from said first material; and c) said second material is a non-magnetic material.

9. A shield for a computer monitor of the type including an evacuated tube having a screen portion, a bell portion and a neck portion; means for generating a beam of charged particles toward the screen portion; and means disposed at the neck portion for deflecting a beam of charged particles; the deflecting means having a diameter; said shield comprising:

a) a hollow cylindrical magnetic sleeve configured for being disposed around at least a portion of the deflecting means;

b) said sleeve including front and rear spaced opposed portions;

c) a front tab extending a first predetermined distance from said front portion for establishing a standoff distance between said magnetic sleeve and a bell portion of an evacuated tube, said standoff distance establishing a critical threshold between the bell portion and said magnetic sleeve for curing critical interference; and d) said sleeve has a diameter greater than the diameter of the deflecting means.

10. A shield as in claim 9, and further comprising:

a) a rear tab extending a second predetermined distance from said rear portion.

11. A shield as in claim 10, wherein a) said first predetermined distance is greater than said second predetermined distance.

12. A computer monitor, comprising:

a) an evacuated tube having a screen portion, a bell portion and a neck portion;

b) means for generating a beam of charged particles toward said screen portion;

c) means disposed at said neck portion for deflecting said beam of charged particles, said deflecting means having a diameter;

d) a hollow cylindrical magnetic sleeve disposed around at least a portion of said deflecting means;

e) a leg attached to said sleeve for establishing a standoff distance between said magnetic sleeve and a bell portion of an evacuated tube, said standoff distance establishing a critical threshold between the bell portion and said magnetic sleeve for curing critical interference;

f) said leg extending outwardly of said sleeve and including a foot configured for contacting the bell portion of the evacuated tube;

g) said foot being disposed at a predetermined distance from said sleeve and establishes said critical threshold; and h) said sleeve having a diameter greater than the diameter of said deflecting means.

13. A monitor as in claim 12, wherein:

a) said monitor includes wires disposed from said neck portion toward said screen portion; and b) said sleeve includes a front portion having a perimeter cutout; and c) said cutout defines an opening between said front portion of said sleeve and said bell portion through which said wires pass through from within said sleeve, thereby permitting said sleeve to have a close fit with said bell portion.

14. A monitor as in claim 13, wherein:

a) said monitor includes a video board disposed at said neck portion and wires connecting said video board to other circuit components disposed on a monitor chassis;

b) said sleeve includes a rear portion having a perimeter cutout; and c) said rear portion perimeter cutout is adapted to permit said wires to pass therethrough unobstructedly.

* * * * *